US010080946B1

(12) United States Patent
Zivkovic

(10) Patent No.: US 10,080,946 B1
(45) Date of Patent: Sep. 25, 2018

(54) SELECTABLE BOUNDARY FENCING STRIP

(71) Applicant: Zivkovic Modern Fencing Equipment, Inc., Wellesley Hills, MA (US)

(72) Inventor: Branimir Zivkovic, Wellesley Hills, MA (US)

(73) Assignee: Zivkovic Modern Fencing Equipment, Inc., Wellesley Hills, MA (US)

( * ) Notice: Subject to any disclaimer, the term of this patent is extended or adjusted under 35 U.S.C. 154(b) by 0 days.

(21) Appl. No.: 15/715,045

(22) Filed: Sep. 25, 2017

Related U.S. Application Data

(60) Provisional application No. 62/400,009, filed on Sep. 26, 2016.

(51) Int. Cl.

| | |
|---|---|
| ***G09F 19/18*** | (2006.01) |
| ***A63B 69/02*** | (2006.01) |
| *A63B 71/06* | (2006.01) |
| *G09F 19/22* | (2006.01) |

(52) U.S. Cl.
CPC ..... *A63B 69/02* (2013.01); *A63B 71/0669* (2013.01); *A63B 2069/025* (2013.01); *A63B 2071/0694* (2013.01); *A63B 2210/50* (2013.01); *G09F 19/228* (2013.01)

(58) Field of Classification Search
None
See application file for complete search history.

(56) References Cited

U.S. PATENT DOCUMENTS

| | | | | |
|---|---|---|---|---|
| 2004/0037078 | A1* | 2/2004 | Lee | A47G 23/06 362/249.01 |
| 2007/0082123 | A1* | 4/2007 | Aldarondo | G09F 13/22 427/64 |
| 2009/0020953 | A1* | 1/2009 | Hallsten | A63B 69/02 273/309 |
| 2009/0036205 | A1* | 2/2009 | Seacat | A63B 69/002 463/30 |
| 2009/0088234 | A1* | 4/2009 | Seacat | A63B 71/0605 463/7 |
| 2015/0113842 | A1* | 4/2015 | Suhr | A63C 19/00 40/559 |
| 2016/0351619 | A1* | 12/2016 | Cramer | H04B 1/3888 |

* cited by examiner

*Primary Examiner* — Jason Yen
(74) *Attorney, Agent, or Firm* — William A. Loginov; Loginov & Associates

(57) ABSTRACT

A selectable boundary fencing strip includes a plurality of strip segments of similar size and shape, each provided with a conductive perforated top surface that includes a plurality of holes; a plurality of internal hollow channels within the material of the strip segments; a plurality of illumination sources located within each of the channels, each illumination source being connected to a strip that includes a circuit board and can be connected to a floor of the channel by an adhesive, each being constructed and arranged to indicate each of a plurality of different effects, the illumination sources each being located beneath the conductive perforated top surface so that their illumination is visible through the perforations; a connection with a control board for control of the illumination sources and a computing device that includes a control application; and a plurality of pre-set illuminated boundaries that can be selected and modified.

11 Claims, 7 Drawing Sheets

SELECTABLE BOUNDARY FENCING STRIP

RELATED APPLICATION

This application claims the benefit of U.S. Provisional Application Ser. No. 62/400,009, entitled SELECTABLE BOUNDARY FENCING STRIP, filed Sep. 26, 2016, the teachings of which are incorporated herein by reference.

FIELD OF THE INVENTION

This invention relates to equipment used in the sport of fencing, and more particularly to electrically conductive fencing strips used to record scores in competition.

BACKGROUND OF THE INVENTION

Fencing is a highly competitive and strenuous sport for two contestants ("fencers"). Fencing takes place on a conductive narrow elongated surface, known as a piste, or fencing strip. A fencing competition involves two contestants (fencers) wearing appropriate protective clothing and face masks. In competition, the fencers are judged by a referee who monitors the fencer's activities as each competitor attempts to score touches on key areas of the other one's body with his or her blade. The goal is to touch the tip or edge of the weapon onto the valid surfaces of the competitor. Valid surfaces vary between the different branches of fencing, which are called foil, epee and sabre. Epee and foil blades have electrical contacts on their tips that respond to a touch. The surface of the fencing strip is electrically conductive. Saber blades employ a conductive blade surface. A body cord connects the weapon to the fencer's protective clothing. The floor is conductive so that the electronic signaling unit can receive signals from the weapons and protective clothing and differentiate between a touch landing on the foot of a fencer and a touch landing near the foot but on the floor, which is not a valid touch. The lights on electronic signaling units are green and red (showing touches by one or the other fencer), while touches made on invalid surfaces are shown by white lights for each fencer separately.

When constructed from aluminum (or another metallic) sheet, the fencing strip includes an exposed top surface that is electrically conductive. It is often constructed from aluminum sheet that may or may not include perforations or other structures thereon. The fencing strip is constructed in segments that are joined at joint lines for easy assembly, disassembly, storage and subsequent re-assembly. Appropriate mechanical fasteners and connectors can be used to join the segments together. A fully constructed fencing strip can extend up to at least 17 meters.

Touch signals from each fencer are transmitted through the wires via a connecting cable system to a central scoring console. The scoring console can include a time clock and a pair of score displays/pylons. The entire surface of the strip is conductive and provides a ground plane connected to the competitors When a blade conductively contacts the strip surface during competition, the control system in the console recognizes the touch as one with the strip and registers no score. The conductive surface in combination with an interconnection to the scoring console enables such differentiation.

Accordingly, it is desirable to provide a system that enables a ready display of the score and touches by fencers, regardless of where the fencers are positioned along the fencing strip. It is also desirable to provide displays of advertising and sponsorship to defray costs of events and fencing organizations.

SUMMARY OF THE INVENTION

The present invention overcomes the disadvantages of the prior art by providing a selectable boundary fencing strip that can comprise a plurality of strip segments of similar size and shape, each provided with a conductive perforated top surface that includes a plurality of holes; a plurality of internal hollow channels within the material of the strip segments; a plurality of illumination sources located within each of the channels, each illumination source being connected to a strip that includes a circuit board and is connected to a floor of the channel by an adhesive, each being constructed and arranged to indicate each of a plurality of different illumination effects, the illumination sources each being located beneath the conductive perforated top surface, the conductive top surface being perforated so that the illumination sources project illumination, and their illumination being visible through the perforations; a connection between the illumination sources and a control board for control of the illumination sources by switching the illumination sources on and off; a connection between the control board for control of the illumination sources and a computing device that includes a control application; and a plurality of pre-set illuminated boundaries that can be selected and modified. The perforated holes can be constructed with a diameter of 3 mm. Each of the strip segments can be constructed with six hollow channels and six columns of perforated holes. The hollow channels can be of equal sizes. The hollow channels can be of unequal sizes and can be provided with more than one strip of illumination sources. The perforation holes can be arranged in a plurality of columns that are aligned such that the holes form ranks with each other. The perforation holes can be arranged in a plurality of columns that are aligned such that each of the columns is offset relative to the others. The illumination effects can be displays of scores for competitors competing in a competition, logos for event sponsors and logos for event hosts.

BRIEF DESCRIPTION OF THE DRAWINGS

The invention description below refers to the accompanying drawings, of which.

DETAILED DESCRIPTION

Figure 1:
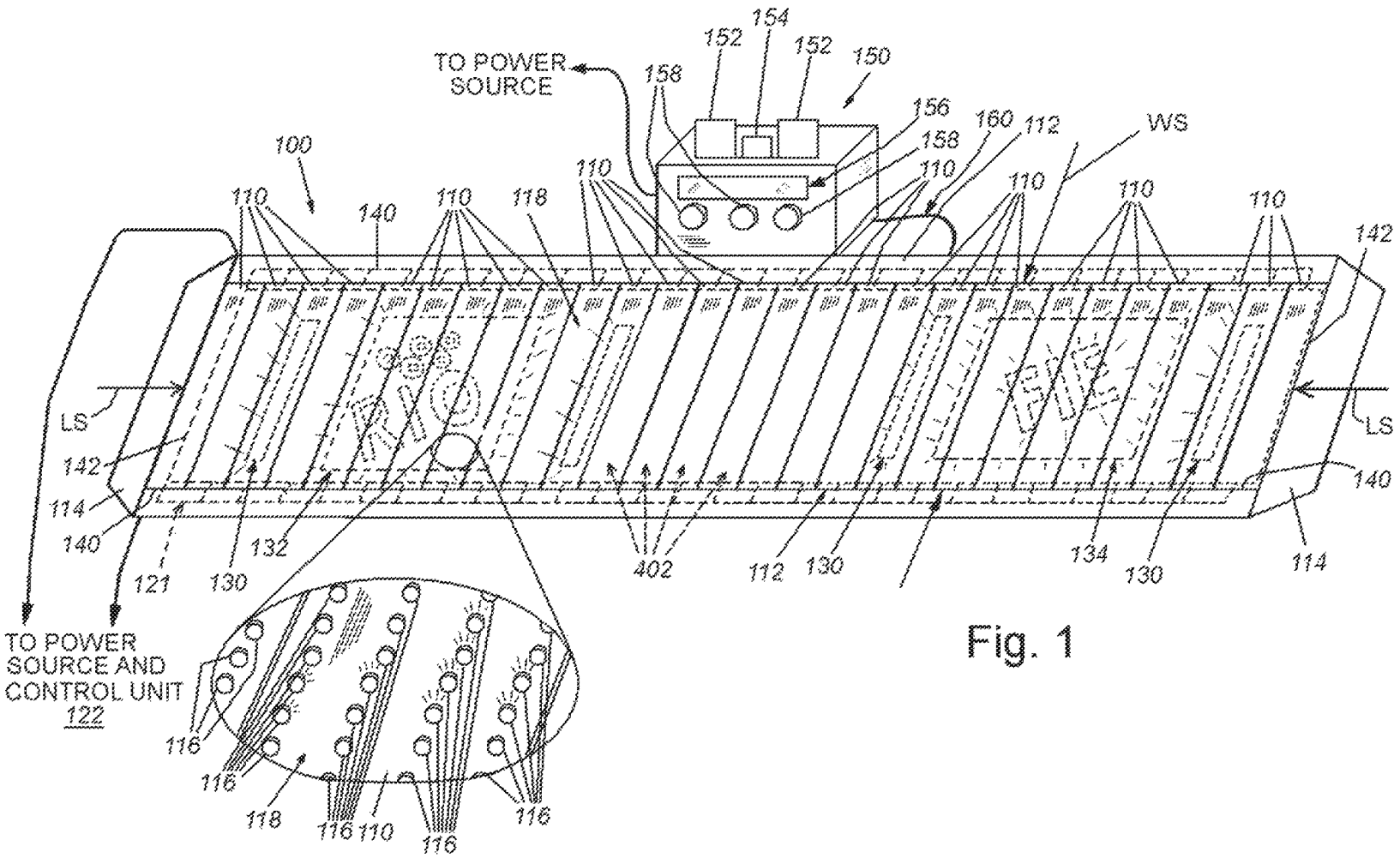
FIG. 1 is a perspective view of a selectable boundary fencing strip, according to an embodiment.

A fencing strip assembly 100 and scoring console assembly 150 are shown in FIG. 1, according to an illustrative embodiment. The fencing strip assembly 100 is a composite of a plurality of interlocking strip segments 110 that are joined at joint lines for easy storage and subsequent assembly during a match. To assemble a fencing strip assembly 100, the individual strip segments 110 are laid side-by-side and anchored on each side by a linear arrangement of side stringers 112 and at either end, by end segments 114. The fencing strip assembly 100 (also called a 'piste') is a level surface upon which fencing competition events are conducted and the top surface is electrically conductive. Appropriate mechanical fasteners and connectors can be used to join the segments together. The individual strip segments 110 are segments of similar size and shape and are formed of a lightweight metal, such as aluminum, each of which can be constructed with a plurality of drilled holes 116 in the surface. Each strip segment 110 can be placed alongside other strip segments and connected at each end to the side stringers 112. The strip segments 110 include a hollow interior 120 (described more fully below) that is sufficiently dimensioned to provide a platform for strips of LEDs (light emitting diodes') that are disposed within the strip segments 110. The drilled holes 116 extend from the top surface 118 to the hollow interior channels 402 (described more fully below). When the LEDs are activated and illuminate, their light passes through the perforations 116 and are visible to the contestants and judge on the fencing strip assembly 100 and the onlookers in the audience.

A wiring harness 121 for the purpose of transmitting power and instructions to each LED strip to illuminate is disposed within each of the side stringers 112 to connect the LEDs of each strip segment 110 to a power supply and control unit 122. The control unit 122 can include a user interface and a processor that enables the operator to instruct lighting arrangements that cause various of the LED strips to illuminate in a particular color and pattern, for example, an illuminated bar 130, an event logo 132, or the logo of a sponsor 134. In other embodiments, the illuminated displays of the LED strips can include scores, animations, or other images.

The length LS of the competitive length of the strip assembly 100 can vary depending upon the class of the competitors and can be varied by adding or removing strip assemblies 110 to the desired length. For example, a senior setting describes an active area of 14 meters in length and 1.5 meters in width WS for a fencer over 16 years of age and of largest stature. A junior setting describes an active area of 11.20 meters in length and 1.5 meters in width for a fencer between the ages of 10 and 15 years and of middle stature. A cadet setting describes an active area of 11.20 meters in length and 1 meter in width for a fencer between the ages of 7 and 9 years and of smallest stature. The length and width can also be modified by changing illuminations, that is to say, creating illuminated side lines 140 and end lines 142 that can be expanded or contracted by input by the operator to the control unit 122. The scoring relies upon contact by the fencers with an opponent's fencing epee (in other embodiments, a saber). These contacts (touches') complete a circuit that links the epee to the competitor's tunic that is connected to the fencer's shoes that are in turn connected electrically to the strip and, in turn can be connected to the scoring console assembly 150. This can be connected to an interface system of the electronic signaling unit that can send signals to the LED lights within the fencing strip that will then be illuminated in different colors from within the fencing strip, the colors selected according to the particular fencer and the validity of the touch.

The scoring console assembly 150 can include one or more illuminated scoring towers 152, a timing clock display 154, a scoring display surface 156 and various lights 158 for illuminating contacts between the competitors.

As used herein the directional terms, such as, but not limited to, "up" and "down", "upward" and "downward", "rear", "rearward" and "forward", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a direction of the force of gravity.

Figure 2:
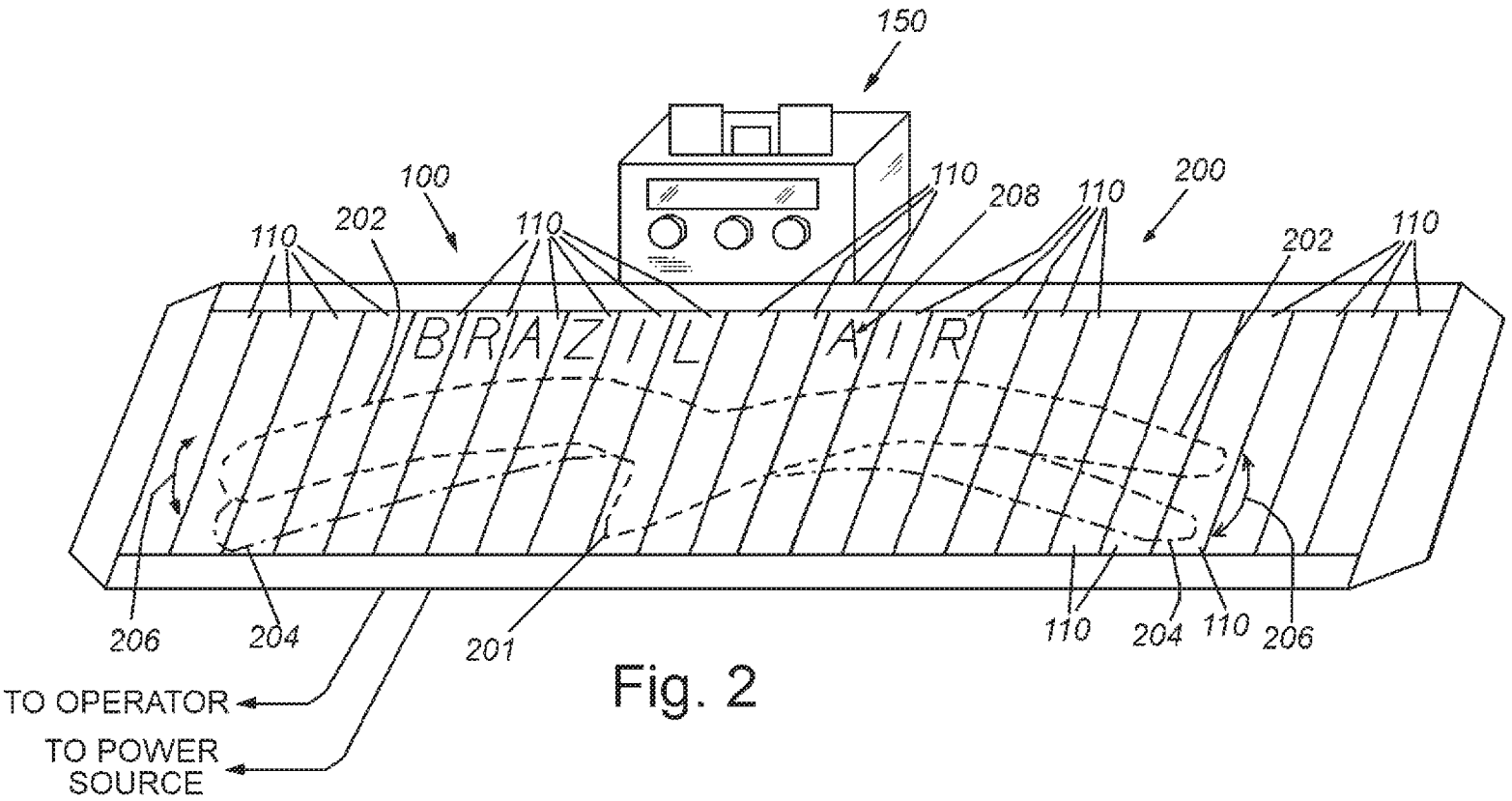
FIG. 2 is a perspective view of a selectable boundary fencing strip, according to the embodiment.

Portions of the fencing strip assembly 100 can be illuminated so as to produce either a static or moving image 200, as shown in FIG. 2. In the illustrative embodiment, a logo 201 is formed by an arrangement of designated LEDs within the fencing strip assembly 100 and is visible by the various perforations in the strip segments. The logo can be of any shape, size or color, as desired by the operator. Activation and deactivation of LEDs can create an illusion of movement in the logo presentation, from a first position 202 to a second position 204. By switching individual LEDs in each strip on and off, an illusion of apparent motion 206 can be created. The brand name 208 associated with the logo can also be presented. It is contemplated that such displays can move back and forth, include strobe or flashing effects, and be operated directly (presented when desired), or indirectly (e.g., pre-programmed presentations) by an operator.

Figure 3:
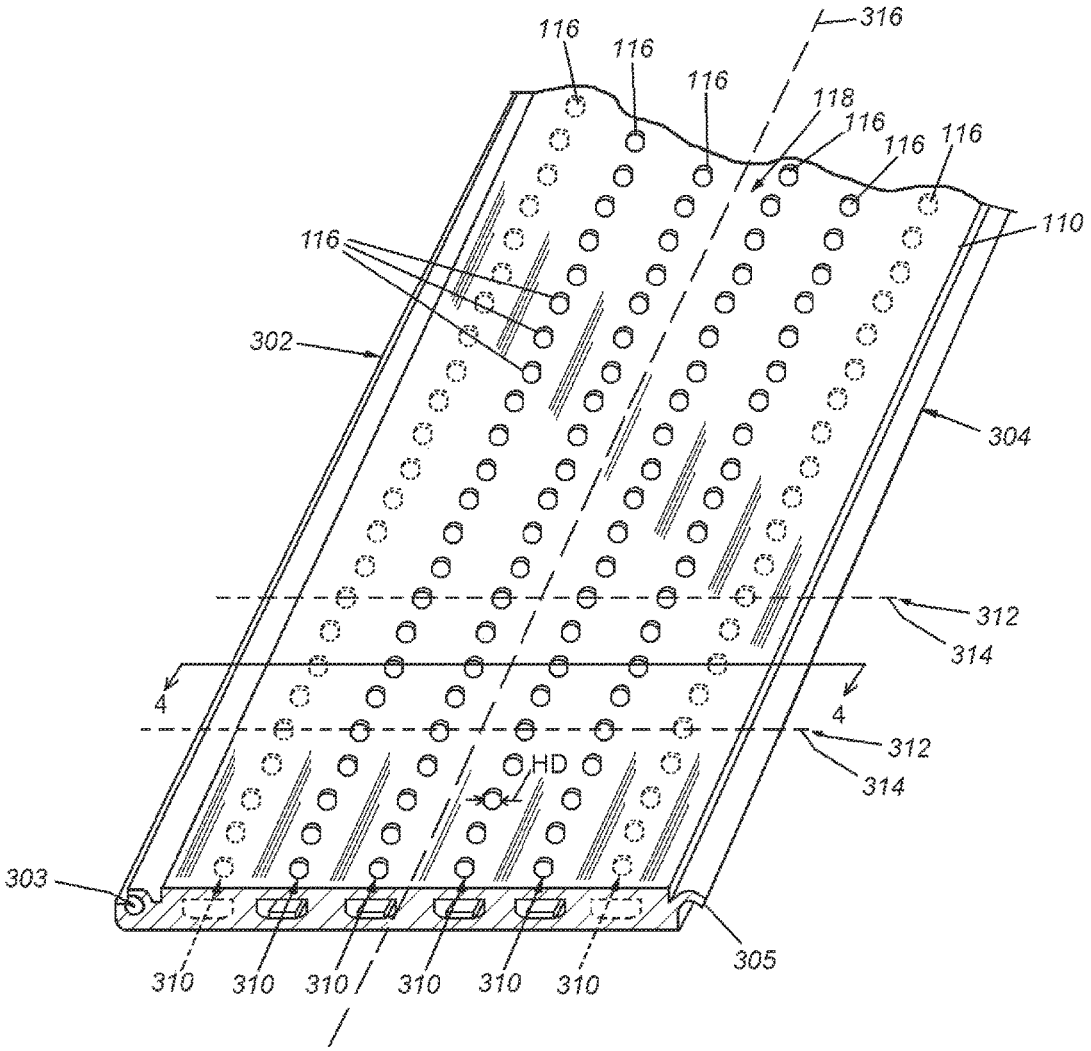
FIG. 3 is a perspective view of a portion of a selectable boundary fencing strip, according to the embodiment.

A portion of a fencing strip segment 110 is shown in FIG. 3. The exemplary strip segment 110 has interlocking sides for engaging adjoining strip segments. In an embodiment, a strip segment 110 can be provided on one side with a "female" 302 interlocking side that is defined by an inset receiving channel 303. A "male" 304 interlocking side is provided on the side opposite the female side and is defined by a protruding interlocking feature 305 that is sized and proportioned to engage with the female interlocking side of another strip segment (not shown). The interlocking sides can engage with the respective interlocking sides of any strip segment, and the order in which the strip segments are arranged vary greatly vary. This is particularly so where the illumination effects of the LEDs within each strip can accommodate a non-repetitive sequential arrangement of the strip assemblies, so that no two strip segments have to be laid side by side, each time, and the operator does not have to follow a particular sequence of assembling the individual strip segments to form a strip assembly. The final strip segments will each have a "male" or "female" interlocking feature so that they can engage and interlock with the respective interlocking side of the penultimate strip segments at either end of the strip assembly. This arrangement allows for a strip to be put together and disassembled with relative ease, and transportation of a disassembled strip utilizes far smaller dimensions that attempting to transport a piste that is a single unit of composed of two or three portions. The strip segments each can be conveniently stacked one atop the other.

The strip segment 110 of FIG. 3 is depicted as having holes 116 arranged in linear columns 310 and having four parallel columns arranged so that the holes 116 are in ranks 312, with each hole in a rank disposed along an axis 314 that runs across the strip segment 110 and is perpendicular to an axis 316 that extends down the length of each strip segment, from one end to another. In other embodiments, the columns can be offset with respect to each other, so that the holes do not form in ranks. While four columns are depicted in the illustrative embodiment, it is contemplated that there can be six columns of holes (with the fifth and sixth columns being shown in broken lines), or more of less than four columns. A greater number of columns and more holes in each column reduces the material (and structural strength) in each strip segment, thereby decreasing the weight, while conversely, fewer holes increases the amount of material in each strip segment and the resultant weight of the assembled strip assembly (and the transportation weight of the strip assembly in its disassembled state).

The individual holes 116 can be formed in any shape, depending on the availability of cutting broaches. In an embodiment, the holes are circular in shape. The diameter HD of an exemplary hole is 3 mm in an illustrative embodiment. The hole 116 functions as a light pipe to transfer illumination from an LED through the body of the strip assembly 110, creating an illumination that is visible both to the participants and the audience. While the diameter of the holes can vary, holes larger than 3 mm in diameter can allow too much light for the illumination, thereby "washing" out the effect, while holes smaller than 3 mm can be restrictive as to how much illumination is transmitted. While the holes 116 as presented in FIG. 3 are uniform in diameter, evenly disposed in columns and ranks, and uniformly circular, it is contemplated that the holes in all or a portion of a column and/or rank can be different in shape and size from any or all of the adjoining holes 116.

Figure 4:
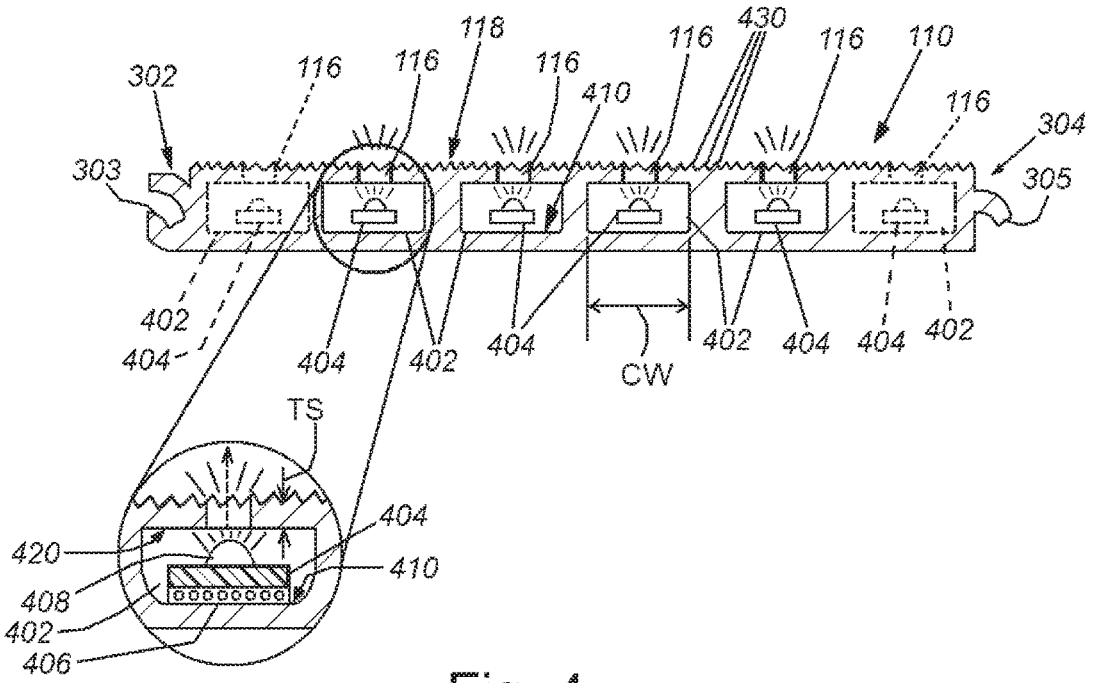
FIG. 4 is a cross-sectional view of a selectable boundary fencing strip along lines 4-4 of FIG. 3, according to a first embodiment.

The cross-sectional view in FIG. 4 shows the arrangement of four columns of FIG. 3. A series of channels 402 are constructed within the material of a strip segment 110, with each channel 402 corresponding to one of the columns 310 of FIG. 3. A LED strip 404 can be placed within each channel 402 and can be secured to the strip segment 110 by an adhesive layer 406 that connects each strip 404 with its LED bulbs 408 to a channel floor 410. The electrical connections pass through each LED strip 404 and to each LED bulb 408. The shape of the profile of each channel is presented in FIG. 4 as uniform and shaped like a recumbent letter "D". In other embodiments, the profile shape of the channels can be rectilinear, triangular, and circular, or have another shape. The thickness TS between the "top"420 of each channel and the top surface 118 can be approximately 1 mm and the width CW of each channel can be approximately 15 mm. In other embodiments, the thickness TS can vary greater or lesser (for example, ±0.25 mm) and the channel width CW can vary greater or lesser (for example, +1 mm). In the present embodiment, each channel 402 is depicted as having a single LED strip 404. In other embodiments, each channel can be provided with more than one LED strip 404, so that two, three or more LED strips can be arranged within a single channel.

The channels 402 can be machined within the material of a strip segment. Given that the strip is metallic, either aluminum, an aluminum alloy or another metal, the machining itself will provide a finish to the surface of the channel walls that can be polished to increase the reflectivity of the channel walls, thereby increasing the strength of the illumination effect as light passes more easily through the holes 116 after bouncing around the interior surfaces of the various channels. It is contemplated that a more reflective surface material can be applied to the interior surfaces of the channels, so that each channel surface becomes a mirror and most of the light emitted by the LEDs eventually passes through the holes 116, thereby greatly increasing the luminosity of the illumination effects. Such a surface treatment can be an applied paint, applied layer of a reflective foil, or other treatment.

It is further contemplated that other illumination sources, or a mixture thereof, can be used as replacements for the LED strips described in the foregoing. For example, a plasma lighting source, a fluorescent bulb arrangement, illumination by an array of fiber optical cables, or another light source can be installed instead of LED strips. It is further contemplated that utilizing stronger LED bulbs or alternative illumination sources can result in heat build up within the channels as a result of sustained illumination, and that heat radiating ports and/or ventilation ports assisted by forced air can be desirable modifications to the fencing strip assembly. In the illustrative embodiment, the top surface 118 of the strip segment 110 is milled so that small ridges 430 are created to provide traction for the competitors and officials when moving back and forth along the strip assembly.

Figure 5:
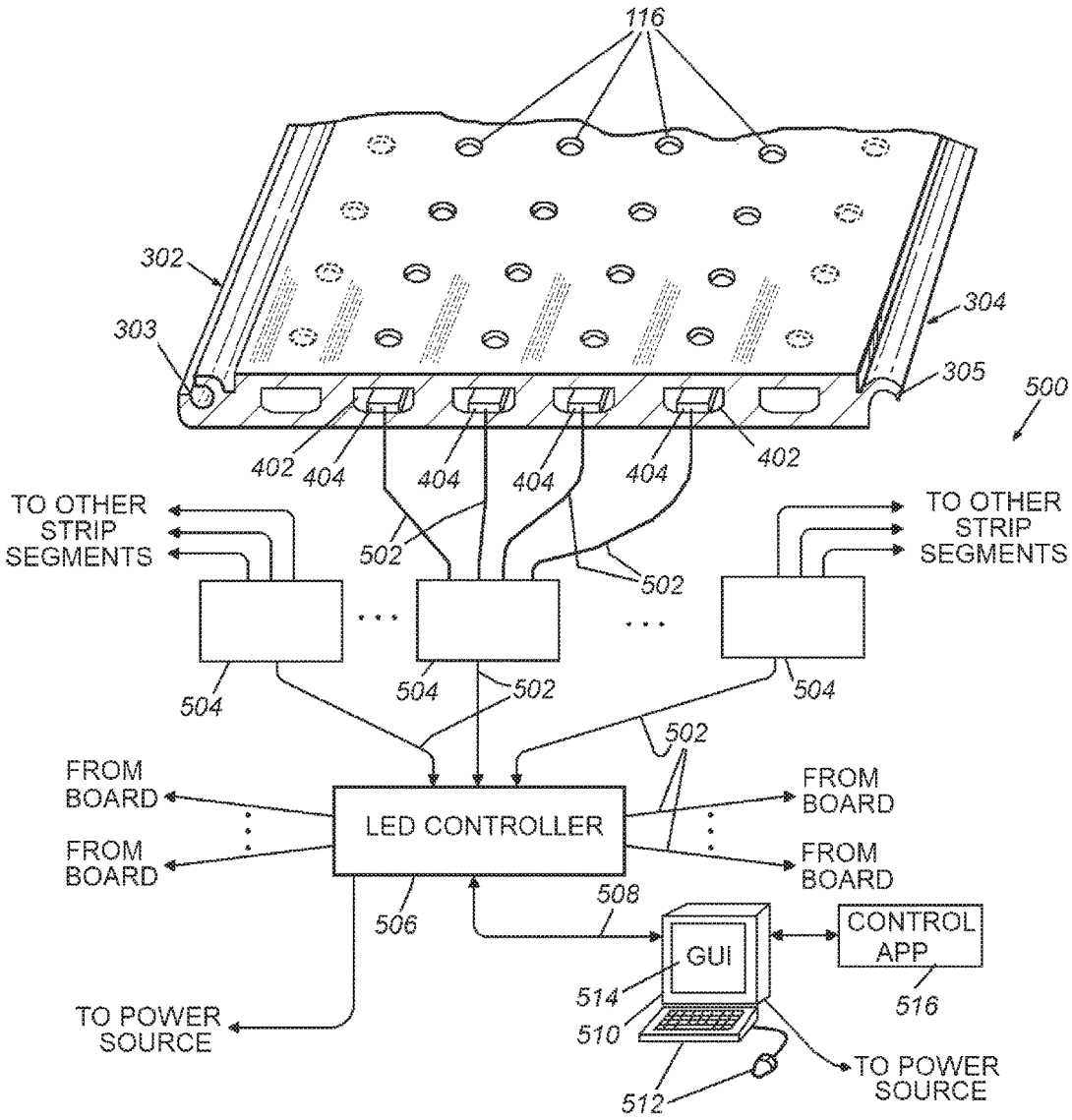
FIG. 5 is a system diagram of a selectable boundary fencing strip, according to the embodiment.

FIG. 5 includes a schematic plan of an exemplary wiring harness 500 for the strip segment 110 of FIG. 4, showing the wiring harness in greater particularity. In an embodiment, each LED strip 404 is constructed with an internal circuit board that can switch various of the component LED bulbs on and off. Each LED strip 404 can be connected by wires 502 to one of a plurality of connectors 504.

The connectors 504 are connected by wires 502 to a LED controller 506. The LED controller 506 receives instructions from an operator via a control application 516 and relays those instructions via at least one connector 504 to various of the LED bulbs in their respective LED strips to create a desired illumination effect. A computer 510 is provided with a user input assembly 512 (for example, touch pads, voice activation, a keyboard and/or a mouse) and a Graphic User Interface (GUI) that is presented on a GUI display 514. A wiring harness can connect the computer 510 to the LED controller 506.

In other embodiments, the various LED strips can be provided with a wireless receiver for instructions for the LED bulbs to switch on and off that can be linked to a wireless transmitter in the computer. The computer 510 can be a tablet device, personal communications device (for example, a phone) or another personal computing device.

Figure 6:
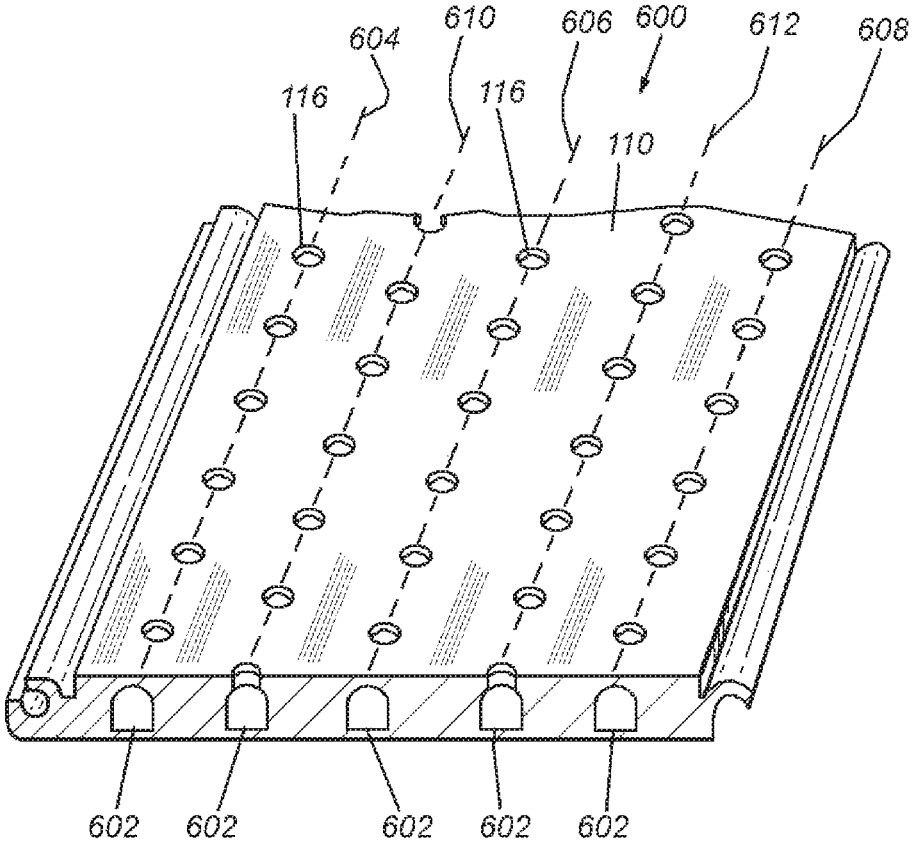
FIG. 6 is a partial cross-sectional view of a selectable boundary fencing strip, according to an alternate embodiment.

A strip segment 110 wherein the holes 116 are arranged in columns that are offset with respect to each other and do not form rows perpendicular to the plane of the strip segment as described in FIG. 3, above, is shown in FIG. 6. The exemplary channels 602 are shown as bell-shaped in profile. The arrangement of the holes 116 is such that the holes 116 of the first column 604, third column 606 and fifth column 608 are aligned with each other, while the holes 116 of the second column 610 and the fourth column 612 are aligned with each other, but not with those of the first, third or fifth columns. Various other arrangements of holes are expressly contemplated.

Figure 7:
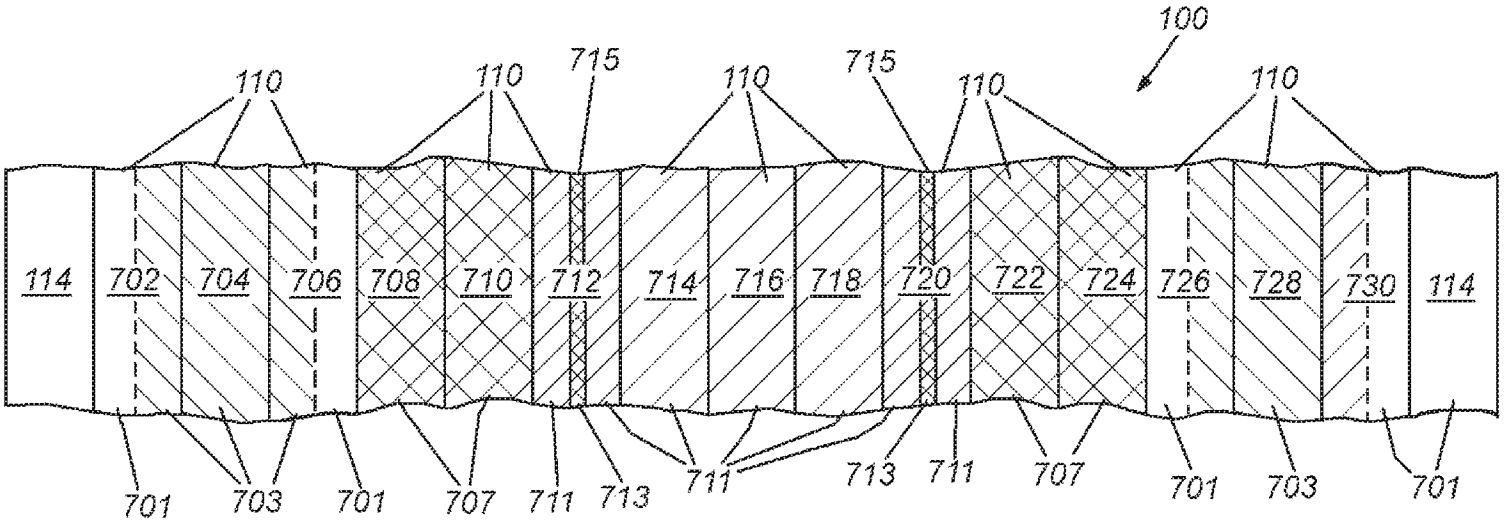
FIG. 7 is a schematic view of an exemplary illuminated fencing strip.

FIG. 7 shows a portion of a fencing strip assembly 100 that is comprised of a pair of end segments 114 and 15 strip assemblies 110. The illumination in the strip assembly 100 is for a conventional fencing piste, without a concurrent logo display. The individual strip assemblies 110 have been instructed by an operator to illuminate a strip for a fencing competition event and each of the LEDS has been instructed to switch on or off, and if switched on, which color to present. In the embodiment, the end segments are not illuminated. In an embodiment, no illumination 701 has been instructed for portions of segments 702 and 706. A first illumination color 703 has been instructed for part of segment 702, all of segment 704 and part of segment 706. A second illumination color 707 has been instructed for segments 708 and 710. A third illumination color 711 has been instructed for segments 714, 716 and 718. In segments 712 and 720, a fourth illumination color 713 has been instructed for columns of LED lights in the centers of the strips, surrounded by the third illumination color 713, to create transverse lines 715. The second illumination color 707 has been instructed for segments 722 and 724. No illumination 701 has been selected for parts of segments 726 and 730. The first illumination color 703 has been instructed for segment 728 and parts of segments 726, 730. This arrangement of colors is shown purely by way of example, and other arrangements of colors are specifically contemplated.

It should be clear that the embodiments of the selectable boundary fencing strip described above provides a system that can be used to project graphics upon a fencing strip. These illuminations can present a conventional fencing piste, lines scores and information about competitors, and logos for sponsors and hosts of the event. Such graphics can be fixed or changeable and are controllable by an operator. The graphics can be presented to simulate animated movement. The illuminating sources are placed within channels that can be machined within the material of the strip segments and can connect, via connectors to a LED controller and in turn, to a power source and a user input device (i.e., a computer).

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, using multi-color light arrays, various colors can be accommodated without increasing the size of the illumination array's footprint within the strip. The illumination effects can be automatically generated when a touch occurs by pre-programming using the control application. In a similar fashion, an illumination of the current scores in the fencing strip can be programmed for after a touch occurs, updating itself as the scores change. Between matches, the strip illumination can feature sponsor logos, event hosts and promotions for the event location and future events. In a further embodiment, the illumination effects can be furnished for financial remuneration to benefit an organization, the teams, or charities. In another embodiment, emergency information can be displayed in the event of an emergency, such as a sudden illness or injury of a competitor or spectator, or evacuation of the facility (for example, providing a giant arrow to point out the emergency exits). Accordingly, this description is meant to be taken only by way of example, and not to otherwise limit the scope of this invention.

What is claimed is:

1. A selectable boundary fencing strip comprising:

a plurality of strip segments of similar size and shape, each provided with a conductive perforated top surface that includes a plurality of holes;

a plurality of internal hollow channels within the material of the strip segments;

a plurality of illumination sources located within each of the channels, each illumination source being connected to a strip that includes a circuit board and is affixed to a floor of the channel, each being constructed and arranged to indicate each of a plurality of different illumination effects, the illumination sources each being located beneath the conductive perforated top surface, the conductive top surface being perforated so that the illumination sources project illumination, and their illumination being visible through the perforations;

a connection between the illumination sources and a control board for control of the illumination sources by individually switching the illumination sources on and off;

a connection between the control board for control of the illumination sources and a computing device that includes a control application; and a plurality of pre-set illuminated boundaries that can be selected and modified.

2. The selectable boundary fencing strip as set forth in claim 1 wherein the perforated holes are constructed with a diameter of one of (a) approximately 2-5 millimeters and (b) approximately 3 millimeters.

3. The selectable boundary fencing strip as set forth in claim 1 wherein each of the strip segments is constructed with six hollow channels and six columns of perforated holes.

4. The selectable boundary fencing strip as set forth in claim 1 wherein the hollow channels are of equal sizes.

5. The selectable boundary fencing strip as set forth in claim 1 wherein the hollow channels are of unequal sizes.

6. The selectable boundary fencing strip as set forth in claim 1 wherein the hollow channels are provided with more than one strip of illumination sources.

7. The selectable boundary fencing strip as set forth in claim 1 wherein the perforated holes are arranged in a plurality of columns that are aligned such that the holes form ranks with each other.

8. The selectable boundary fencing strip as set forth in claim 1 wherein the perforation holes are arranged in a plurality of columns that are aligned such that each of the columns is offset relative to the others.

9. The selectable boundary fencing strip as set forth in claim 1 wherein the illumination effects are displays of scores for competitors competing in a competition.

10. The selectable boundary fencing strip as set forth in claim 1 wherein the illumination effects are displays of logos for event sponsors.

11. The selectable boundary fencing strip as set forth in claim 1 wherein the illumination effects are displays of logos for event hosts.

* * * * *